United States Patent [19]

Elmali et al.

[11] Patent Number: 4,895,091

[45] Date of Patent: Jan. 23, 1990

[54] REVERSIBLE CAMBER LINE FLEXIBLE WING SAIL

[76] Inventors: Nuri E. Elmali; Martha T. Elmali, both of 2532½ 49th St., St. Petersburg, Fla. 33707

[21] Appl. No.: 259,357

[22] Filed: Oct. 17, 1988

[51] Int. Cl.[4] ..... B63H 9/06

[52] U.S. Cl. ..... 114/103

[58] Field of Search ..... 114/39.1, 39.2, 102, 114/103, 104, 105, 106

[56] References Cited

U.S. PATENT DOCUMENTS

| | | | |
|---|---|---|---|
| 3,580,203 | 5/1971 | Martin | 114/102 |
| 3,598,075 | 8/1971 | Kenney | 114/102 |
| 4,064,821 | 12/1977 | Roberts et al. | 114/102 |
| 4,341,176 | 7/1982 | Orrison | 114/102 |
| 4,624,203 | 11/1986 | Ferguson | 114/102 |
| 4,741,281 | 5/1988 | Doyle | 114/102 |
| 4,766,831 | 8/1988 | Johnston | 114/102 |

FOREIGN PATENT DOCUMENTS

| | | | |
|---|---|---|---|
| 2190056 | 11/1987 | United Kingdom | 114/103 |

*Primary Examiner*—Joseph F. Peters, Jr.
*Assistant Examiner*—Stephen P. Avila

[57] ABSTRACT

The invention is a soft wing sail consisting of membrane covering its both sides, between which a set of batten assemblies placed at vertical intervals, each extending from luff to leech, enabling the airfoil to retain a pre-engineered, variable and reversible asymmetrical working chordal profile. The batten assemblies include a draft member assembly composed of draft members of lengths varying in conformance to the pre-engineered chordal curvatures of the airfoil, batten channels and a luff member assembly. The interrelation and interaction of these components are such that when the airfoil is loaded from one side, the surface pressure transforms the chordal curvature of the windward side to its pre-designed shape, whereas the windward side transmits the loads to the leeward side to help transform it into a shape featuring a curvature pre-designed for the leeward surface, hence creating an asymmetrical chordal profile with different chordal curvatures on both sides. Upon tacking the airfoil, the previous load status and hence the geometrical status of the airfoil reverses. Owing to the vertical intervals in between the batten assemblies, the airfoil can be reefed in the manner of slab reefing, for which a novel method of reef typing is introduced, intending to provide further convenience in reef handling.

14 Claims, 11 Drawing Sheets

REVERSIBLE CAMBER LINE FLEXIBLE WING SAIL

BACKGROUND OF THE INVENTION (a) Field of the Invention

The field of this invention relates to airfoils in the form of flexible wing sails used to generate propelling forces.

(b) Description of the Prior Art

The evolutionary course of sail design has long been in the pursuit of utilizing wing forms featuring two fairing surfaces forming aerodynamically efficient shapes with a draft area between them at their typical chordal plane.

Briefly, the fundamental aerodynamic advantage inferred in the usage of a wing form as a sail, and henceforth an airfoil, is in the spatial relationship around a chordal draft area and between the two separate surfaces with cambers designed to provide different flow lengths after the separation line along the luff, hence in their capability of basically providing a higher surface pressure differential between the windward and the leeward surfaces as opposed to single ply conventional sails and is, in itself, a well established phenomenon as taught by the discipline of aerodynamics.

In pursuit of achieving maximum possible performance, prior art in sail design has numerous examples of attempting to create wing shaped sails both in theory and in practice, which can be observed in general categories such as:

A—Wing structures with symmetrical chordal profiles rotatable around a vertical axis, B—Composite chordal profiles such as:

(1) wing masts with symmetrical chordal profiles also rotatable around a vertical axis, carrying single ply sails, (2) plurality of rigid wing structures with symmetrical chordal profiles movably related to each other to create a general asymmetrical chordal profile and sail twist in the totality of such assemblies, C—Asymmetrical chordal profiles:

(1) two ply sails wrapped around a spar, providing a relatively less turbulent separation zone, as well as a better flow length ratio between the windward and the leeward plies at both tacks, (2) wings with asymmetrical but fixed chordal profiles that can only be tacked when they are rotated end to end around a pivot at the center of their spans and around a horizontal axis, (3) plurality of wing structures with asymmetrical but rigid chordal profiles attached to support structures that can be rotated around a horizontal axis so that the totality of the wing assembly can be tacked, (4) padded sails consisting of two plies with shaped foam layers placed in between, (5) double luffed sails.

(c) The objective of the invention

In view of the past pursuits of the prior art in wing sail design, the relevant data as shown by aerodynamics, and the entire scope of the operational conditions encompassing the full spectrum of sail use, the functional and operational criteria which constitute the optimum characteristics of a sail assembly can be summarized as follows:

(1) A form that can provide aerodynamic efficiency as close as possible to the theoretical limits of performance at all attitudes and conditions of operation (2) The capability of being hoisted, tacked, trimmed, reefed, lowered and stowed away (3) The capability of performing the functions listed above without applying any external control forces other than conventional tension control means generally used in ordinary sail assemblies.

(4) The capability of being luffed with efficiency such as in the fluttering action of single ply conventional sails, (5) Inherent simplicity of structural, mechanical and material design to the end of requiring relative simplicity in manufacturing, maintenance and repair also achieving cost efficiency.

The existing solutions to the entirety of the problems outlined above do not include any variations that at once meet all of the mechanical, operational and aerodynamic functionality requirements generally suggested by the criteria mentioned in the preceding paragraphs. The objective of this invention is to create a wing sail assembly with novel mechanical characteristics to meet all the requirements of the functional and operational criteria mentioned hereto.

SUMMARY OF THE INVENTION

I. The airfoil system described in this disclosure is a flexible wing sail which is capable of featuring an asymmetrical chordal profile and sail twist at both tacks and at all attitudes, and is one which can be hoisted, trimmed, tacked, reefed, lowered and stowed away in the manner of conventional sails and by use of conventional control means. The mentioned spectrum of functions is achieved by interaction and cooperation of three main sets of elements:

(a) fairing surfaces of flexible membrane sheets that constitute the two sides of the airfoil (b) a series of batten assemblies placed in between the two fairing surfaces at vertical intervals along the span, featuring a novel mechanical function which enables the utilization of surface pressure differential to help create the pre-engineered asymmetrical chordal profile at any tack and attitude under which the airfoil is operating (c) a series of conventional tension control means utilized to hoist, lower, reef and trim the airfoil II. The preferred embodiments of this invention feature a triangular sail plan, since the geometrical variations that occur on the chordal sections of the triangular sail plan pose more complicated problems than that of the rectangular sail plan and hence the mechanical solutions shown in the case of a triangular sail plan include and exceed all the mechanical solutions needed in a rectangular sail plan. From the structural integrity and feasibility standpoint, the invention contemplates extensive use of modern materials with very high strength/-weight ratio and flexibility characteristics, while permitting use of cost effective and precise manufacturing methods.

DETAILED DESCRIPTION OF THE PREFERRED EMBODIMENTS

I. LEGEND

Figure 1:
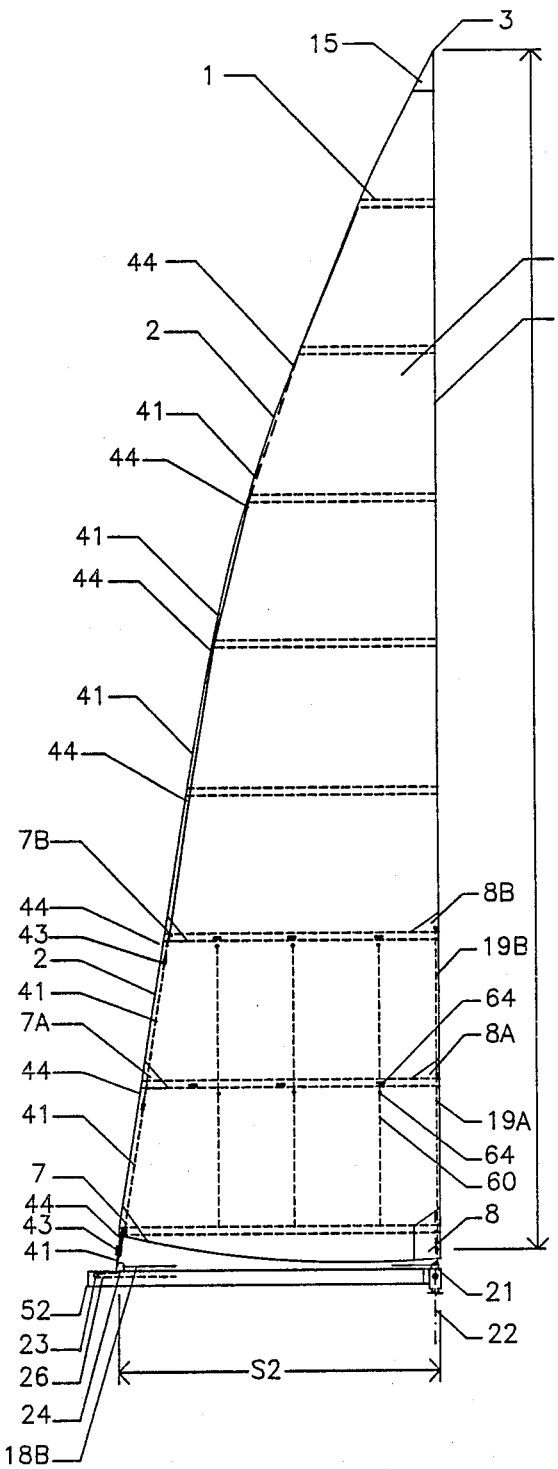
FIG. 1: Is a starboard side elevation of an embodiment of the present invention, shown in its neutral state.

Terminology generally common to related art is used wherever applicable. The following legend covers the terminology used to indicate specific definitions of the members fundamental to the novel functions disclosed:

"'": indicates the port side in general, and also indicating leeward, since the illustrations indicate the leeward status as occurring on the port side.

Fairing surfaces: membrane capable of flexing with minimum possible deformation under load, covering both sides of the airfoil. The design and cut of each flying surface incorporates an identical sail twist feature. Denoted as 9 and 9'. The batten assemblies constituting the spatial interrelationship between the two fairing surfaces are grouped in Type I through Type IV. The said fairing surfaces are to be designed to meet the particular geometrical requirements of the performance parameters sought, and may be cut using the existing techniques of sail design and lofting.

Chordal draft: is the distance between the two fairing surfaces at any given location.

Neutral chord: the shortest distance between luff 4 and the midpoint between two leeches 2 and 2', which also intercepts the longitudinal axis of the neutral leech tension cord 41. Denoted as NC.

Chordal length: the curviliniear distance between luff and leech along a fairing on the chordal plane. Denoted as L and L' in FIGS. 5, 6, and 7.

Chordal distance: the straight line distance between luff 4 and any given draft member tips 25.

Leech chord: the straight line distance between luff and the leech of a fairing surface. Denoted as C and C'.

Camber line (Neutral axis): the locus of the midpoints between two tips of the draft members. Denoted as 13.

Chordal plane: a plane assumed to intersect both fairing surfaces at identical angles in the neutral state of action and which is at a right angle to the vertical plane upon which the span S1 of the airfoil rests.

Chordal surface: the chordal plane having been transformed into a different geometrical status as a warped surface due to the spatial changes induced by the working state of action.

Draft members: members of rigid structure and which span the distance in between the two batten channels 11 and 11' across the chordal plane and laterally to the camber line of the chordal profile. Denoted with various arabic numerals for each batten assembly type, which are 110, 210, 310, 310', and 410. Comparative lengths of the consecutive draft members are determined in accordance with the camber criteria used in the overall engineering of the individual airfoil.

Draft member tips: a detail designed to allow movement of draft members along the batten channels, embodied as two semi-spherical rollers terminating draft members on both ends, denoted as 25 and 25'.

Batten channels: battens capable of flexing on the chordal plane, and which are placed in between draft members and the fairing surfaces. Denoted as 11 and 11'. The flexing action of batten channels result due to the lateral displacement of the draft members transmitting lateral loads between the two fairing surfaces. The geometric status of a batten channel at any given moment therefore is the result of the compound factors of the locus of the draft member tips travelling along the channel, and the surface pressure status upon the fairing surface that a batten channel is interfacing.

Luff assembly: is an assembly of members allowing batten channels and spinal members to rotate along an arc and independently around a common center at the luff and the airfoil, and is denoted as 12.

Support structure: any external structure such as a rig or one of its constituent components, designated to support the said airfoil assembly; not shown in the drawings.

Batten assembly: is the assembly composed of draft members, tips, batten channels, the luff member. This mechanical assembly is identified and explained as four different batten assembly Types in descriptions of respective embodiments. All four types provide the same action pattern under the same principle of transmitting lateral forces between the two sides of the airfoil, however with slightly different geometric displacement patterns and interaction among different constituent members.

Draft member tips 25 and 25', luff assembly 12, fairing surfaces 9 and 9' batten channels 11 and 11', and leech member 20 are components common for all four batten assembly Types.

The detailed description of the preferred embodiments follow a successive order of action stages the system is designed to perform. Definitions of action stages are:

(A) Neutral State is a theoretical reference stage of action used to describe the spatial status of batten assemblies where they rest at a symmetrical form about their camber lines 13, all of which in this state being in their straight line state.

(B) Working State is a stage of action where airflow is applied at a given angle of attack to create a higher surface pressure on the entirety of one of the sides, and a lower surface pressure on the opposite side. As a higher surface pressure condition builds up upon a flying surface, the said side henceforth becomes the windward side, and hence the said windward fairing surface is forced to attain to its pre-designed overall camber. This action also flexes each of the windward batten channels to fully conform with the said camber of the windward fairing surface. The windward batten channels therefore push the draft members towards the leeward side, where the lesser surface pressure and chordal tension provides little resistance, thus flexing the leeward batten channel and subsequently the leeward fairing surface to a curvature that features a camber in conformance to the locus of the leeward draft member tips, and which is a deeper camber than its windward counterpart determined by the lengths of the individual draft members. This action increases the windward leech chord C, and decreases the leeward leech chord C' with respect to neutral leech chord NC.

The sequence of action and principles governing the relative displacement of members involved at the chordal plane are common to all embodiments. Further explanation of the specific details of action pertaining to each batten assembly type is given in descriptions of their respective embodiments.

(C) Luffing State is a stage of action in which the entirety of the system oscillates due to both high and low surface pressure zones occurring simultaneously on each one of the fairing surfaces at alternating locations repetitively. The chordal form changes in this state develop according to the dynamic interaction of the chordal members as explained in the working state.

II. DESCRIPTIONS OF THE DRAWINGS

FIG. 1 is a starboard elevation of the embodiment featuring a triangular sail plan. S1 indicates the span, shown to stand vertically, S2 is the foot length along boom 52 between tack 8 and clew 7. Leeches 2 and 2' are juxtaposed in the vertical projection due to the airfoil being in its neutral state. 3 is the head of the sail common to both surfaces, which includes a common receptacle 15 to accommodate a halyard as the hoisting and lowering means. 4 is the luff extending along the entire span S2. 9 is the membrane forming the starboard fairing surface. Designation 1 indicates the batten assemblies in between two fairing surfaces. 8 is the tack, where 8A and 8B are reef tacks which may vary in number according to specific embodiments. 7 is the starboard clew and 7A', and 7B' are reef clews which may vary in number according to specific embodiments. The neutral leech tensioning cord 41, intermediary leech tensioning block 43, and intermediary leech tensioning cord 44 are described in FIG. 35, FIG. 36, and FIG. 37. 19A and 19B are reefing cords to reef in tacks 8A and 8B respectively.

Figure 2:
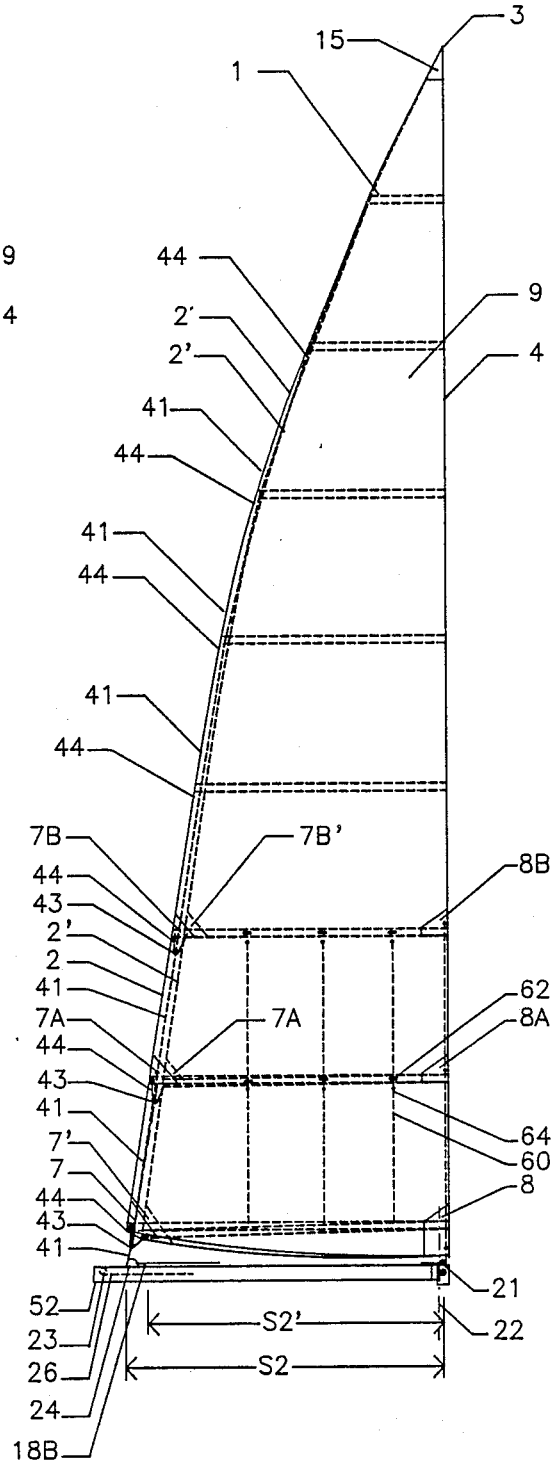
FIG. 2: Is a starboard side elevation of an embodiment of the present invention in its working state at starboard tack, which is the reverse of the same action of the opposite tack.

FIG. 2 is the side elevation of the airfoil in its working state at the starboard tack, where the airfoil is loaded on the starboard fairing surface 9.

Figure 6:
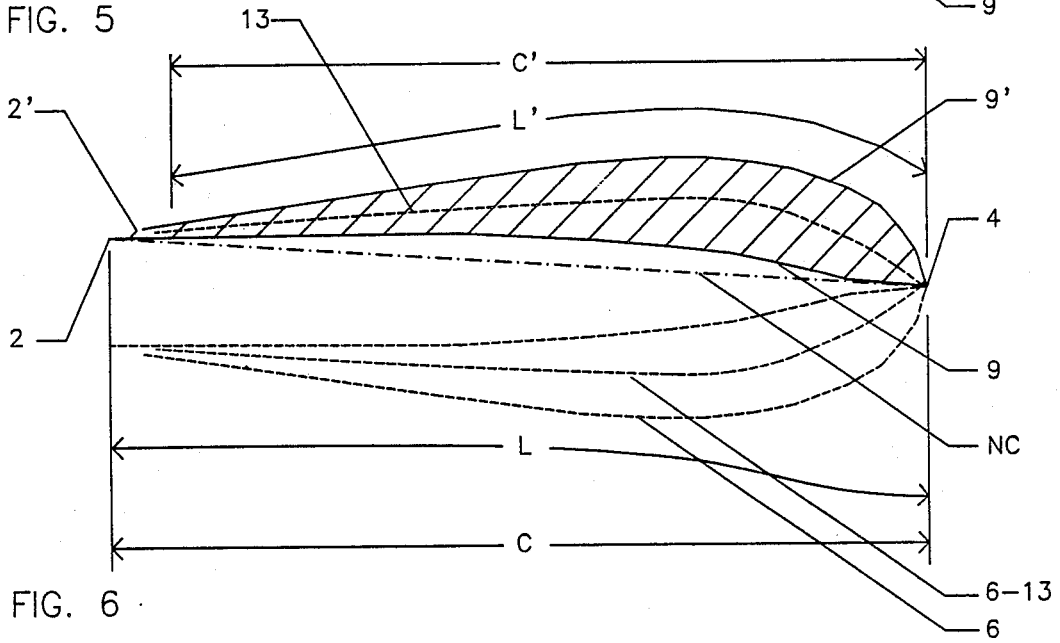
FIG. 6: Is a plan view of the status of the fairing surfaces in the working state at starboard tack.

As the camber of the leeward surface 9' is forced to increase outwardly to the port side as also seen in FIG. 6, the length of leeward leech chord C' decreases and the length of windward surface leech chord C increases, while the curvilinear lengths of the said fairing surfaces L' and L respectively remain equal to each other. Accordingly, due to the triangular shape of the embodiment, the entire length of the windward leech 2 and subsequently all windward clews 7, 7A and 7B perform an aftward and upward swing around the head 3 in the center. As a result of the action described, the leeward leech 2' moves forward, yet since there are no downward forces to apply a downward tension upon it, the leeward leech 2' slackens. An intermediary leech tensioning means is devised to reverse the upward component of the forces acting upon the windward clews into a downward component and transfer it to the leeward leech 2', in order to keep leeward leech 2' taut, and hence prevent it from fluttering as further described in FIG. 35 and FIG. 36.

Since the origin point at luff 4, common for both leech chords C and C', remains stationary, it is seen that while the windward leech chord C rotates upward around its origin at luff 4, conversely the leeward leech chord C' swings upward around the same origin at 4. The new geometrical status of the chordal plane of the neutral stage defined by the curvatures of both leeward and windward batten channels, hence becomes a warped surface. Neutral chord NC, as seen in FIG. 6, remains constant in length at all attitudes as adjusted.

Figure 3:
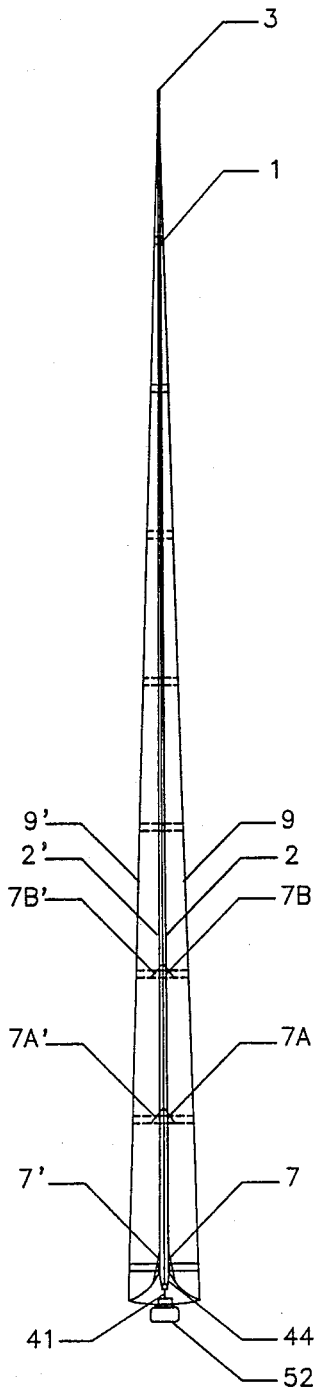
FIG. 3: Is a leech elevation of the embodiment in its neutral state.

FIG. 3 is the leech elevation of the airfoil in its neutral state.

Figure 4:
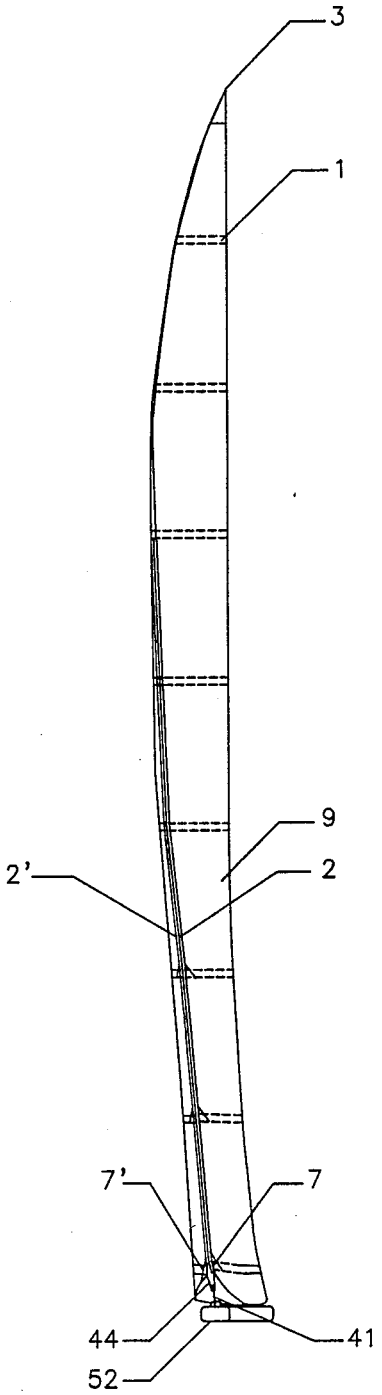
FIG. 4: Is a leech elevation of the embodiment in port tack, displaying the sail twist feature of the invention.

FIG. 4 is the leech elevation of the airfoil in its working state.

Figure 5:
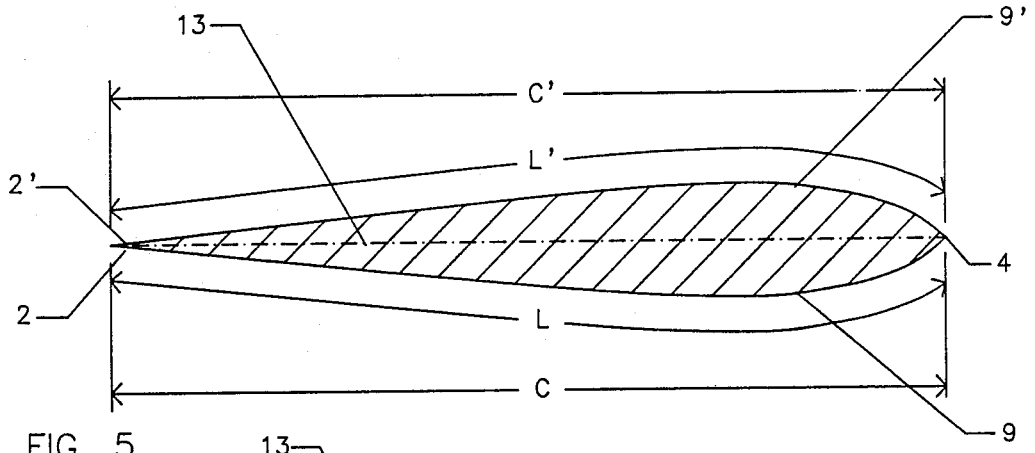
FIG. 5: Is a plan view of the status of the fairing surfaces of the embodiment in its neutral state.
Figure 7:
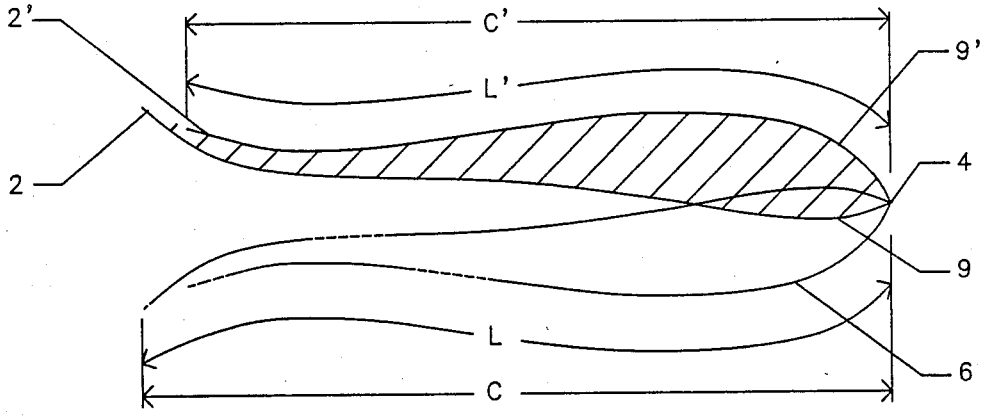
FIG. 7: Is a plan view of the status of the fairing surfaces oscillating in the state of luffing.

FIG. 5, FIG. 6 and FIG. 7 are random horizontal sections taken along the span, showing the relative status of the fairing surfaces common to all types of batten assembly systems at neutral, working and luffing stages of action, respectively. C and C' are chordal lengths of fairing surfaces 9 and 9' respectively. L and L' are the curviliniear lengths of the fairing surfaces on the chordal plane shown. In FIG. 6, NC is the neutral leech chord. In all three illustrations, 6 indicates the reversed spatial status of the chordal form at the opposite tack common to all of the batten assembly types described in the following. The comparative curvature status of the fairing surfaces 9 and 9', as illustrated, are supplemental to the descriptions of the states of action.

Figure 8:
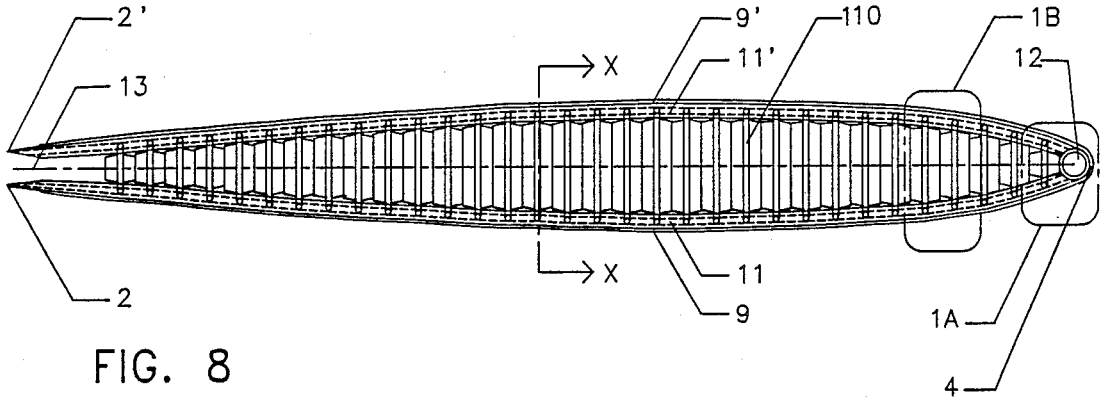
FIG. 8: Is a diagrammatical plan view of Type I batten assembly system consisting of draft members that slide laterally against each other, showing the system in its neutral state.
Figure 20:
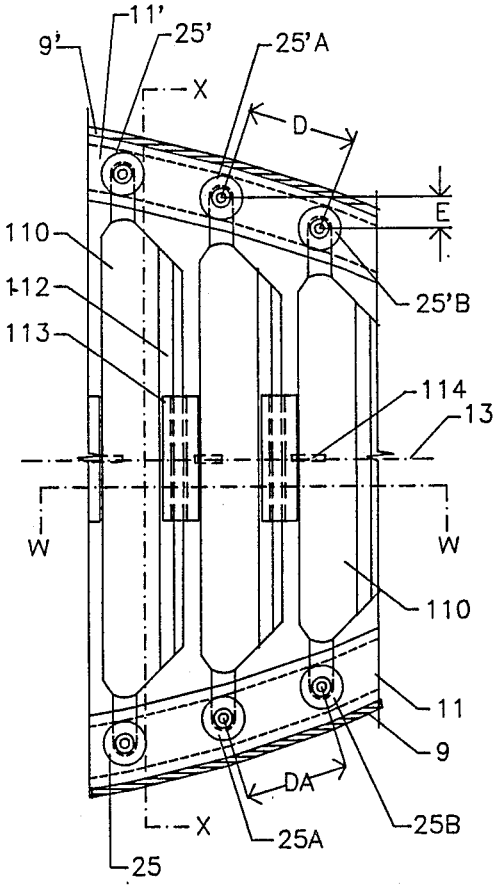
FIG. 20: Detail 1B of FIG. 8.
Figure 21:
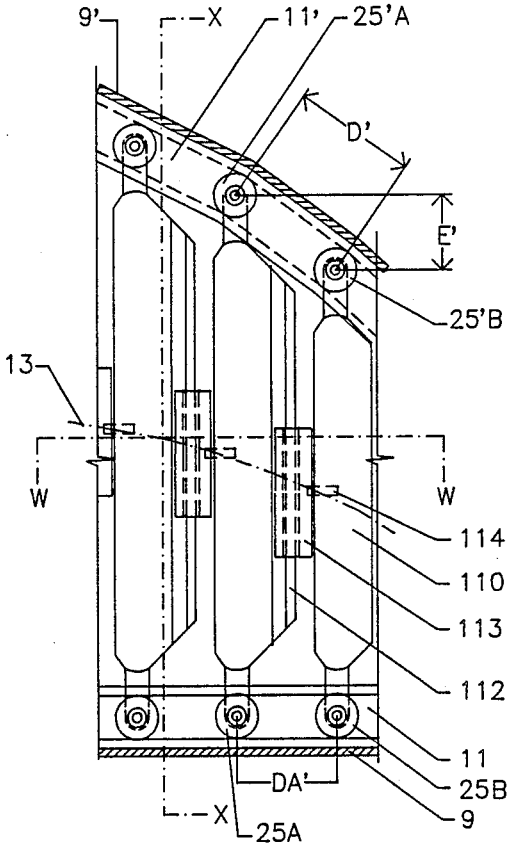
FIG. 21: Detail 1C of FIG. 10.
Figure 34:
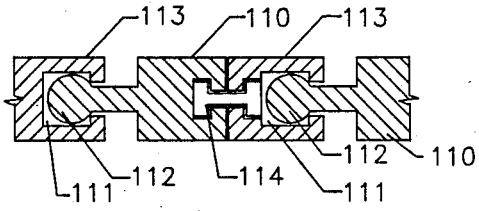
FIG. 34: Section W—W of FIG. 30.

FIG. 8 is a plan view of Type I batten assembly in its neutral state featuring the system where the individual draft members 10 span the entire chordal draft and are so interconnected as to allow a sliding action against each other at directions lateral to the chordal length, and also allowing relative rotation on the vertical transversal plane as in the manner shown in section W—W, illustrated in FIG. 34. Detail 1-A as shown in FIG. 20 and FIG. 21 establishes the spatial relationship of any two tips 25 between each other and the batten channel 11, as well as the spatial relationship between the connectors 113 and draft members 110. 20 is membrane transom sewn on to both leeches 2 and 2' continuously from head 3 to clews 7 and 7'. Membrane transom 20 is cut so that its width varies along its length in conformance to the maximum gap attained between the two leeches 2 and 2' in the working state, so that the membrane transom 20 would attain a taut and flat state, thereby providing a smooth run for a clean airflow at the leech zone of the leeward fairing surface 9'. Membrane transom 20 is a feature of the airfoil common to all the batten assembly types described in the following.

Figure 9:
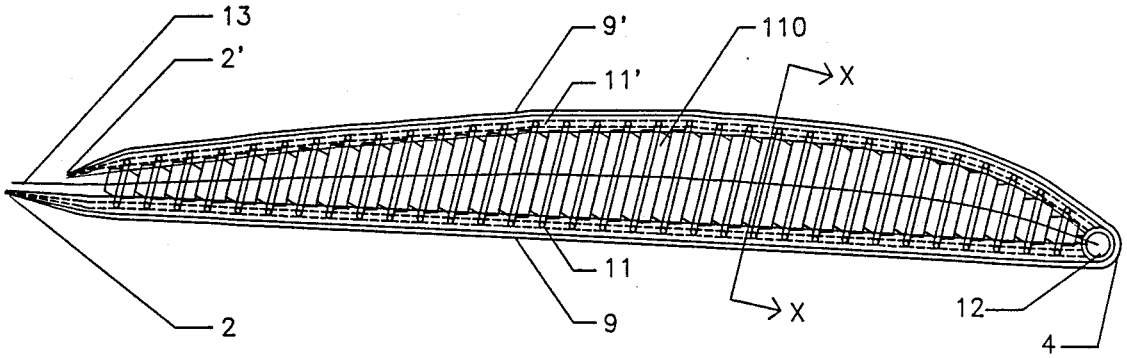
FIG. 9: Is a diagrammatical plan view of Type I batten assembly in FIG. 8 showing system action in the working state at starboard tack.

FIG. 9 is the plan view of Type I system shown in FIG. 8, transformed into its working state. The load transmission between the windward and leeward surfaces occurs through the same action sequence described in Working Stage Definition B in the Legend. Membrane transom 20 is seen to have attained a flat shape.

Figure 10:
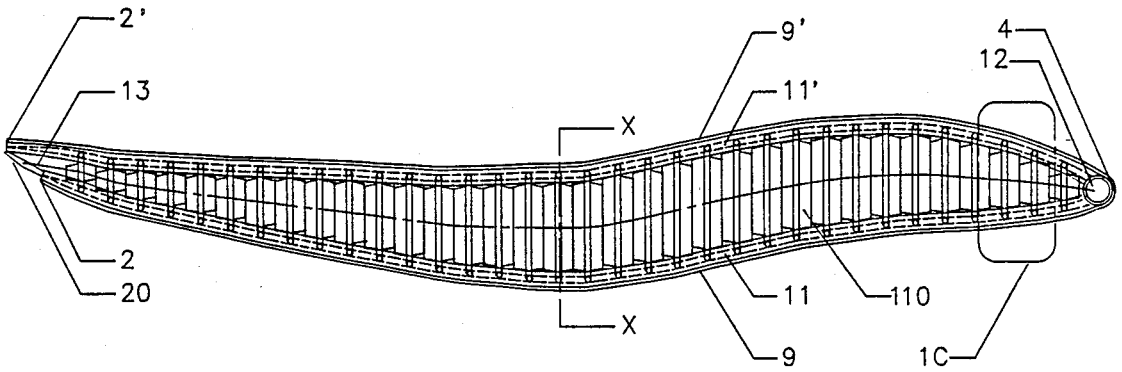
FIG. 10: Is a diagrammatical plan view of Type I batten assembly showing system in oscillation in luffing state.

FIG. 10 shows the luffing state of Type I batten assembly oscillating freely.

Figure 11:
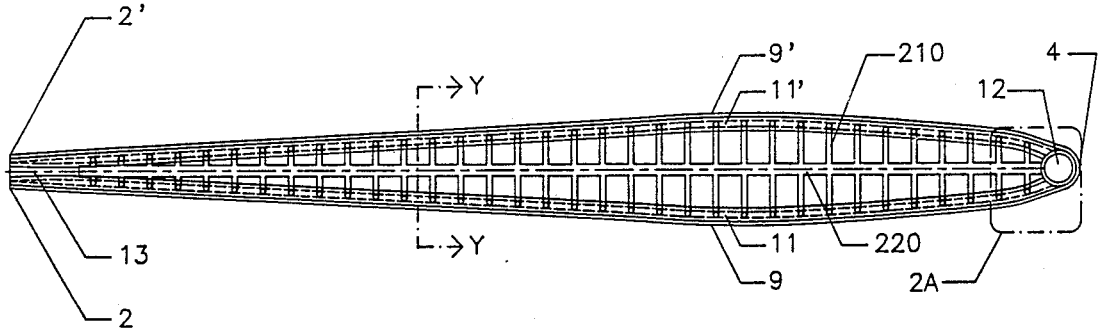
FIG. 11: Is a diagrammatical plan view of Type II batten assembly system consisting of draft members fixed upon both sides of a chordal member extending along the neutral axis.

FIG. 11 illustrates Type II batten assembly in its neutral state. Draft members 210 are non-flexible members spanning the entire chordal draft between the two batten channels 11 and 11' and are rigidly affixed to a longitudinal spline member 220 that is capable of resisting compression longitudinally yet flexing laterally, vertically and torsionally along and around its longitudinal axis in conformance to the torsional changes transforming the neutral chordal plane into a warped surface while the said spline member originates from the luff assembly 12 and extends towards the leech. The longitudinal axis of the spline member 220 is the same as the neutral axis 13 of the batten assembly at all conditions of action.

Figure 12:
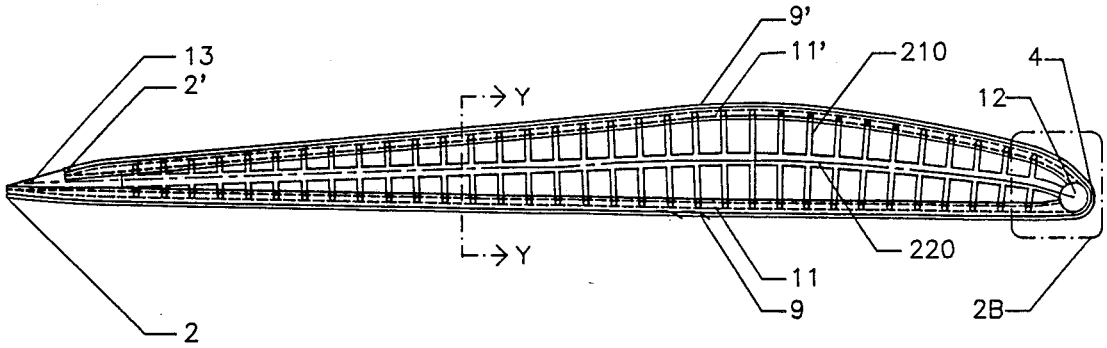
FIG. 12: Is a diagrammatical plan view of Type II batten assembly in FIG. 11 showing system action in working state at starboard tack.

FIG. 12 shows Type II batten assembly in its working state. The load transmission between the windward and leeward surfaces occurs through the same action sequence described in Working Stage Definition B in the Legend. Longitudinal member 220 functions to keep a constant distance between the draft members along the camber line since while its structure allows horizontal, vertical and torsional flexing, it resists longitudinal compression. Further explanation of the action is given in FIG. 22, FIG. 23, and FIG. 34.

Figure 13:
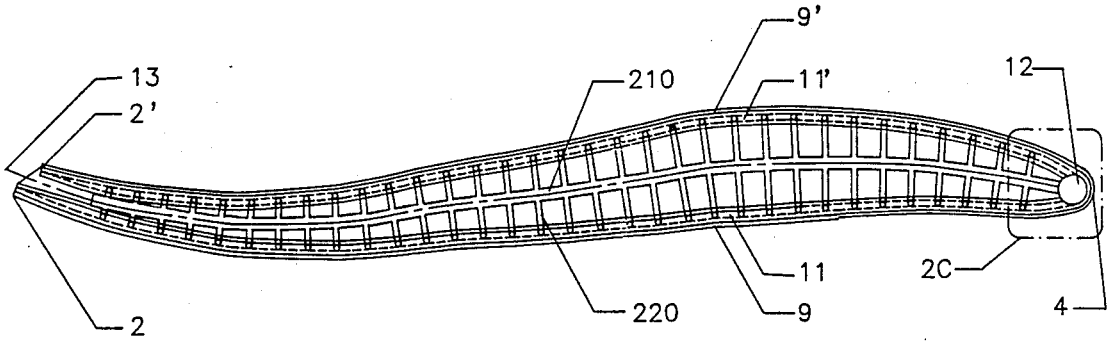
FIG. 13: Is a diagrammatical plan view of Type II batten assembly showing system in oscillation in luffing state.

FIG. 13 shows the luffing state of Type II batten assembly oscillating freely.

Figure 14:
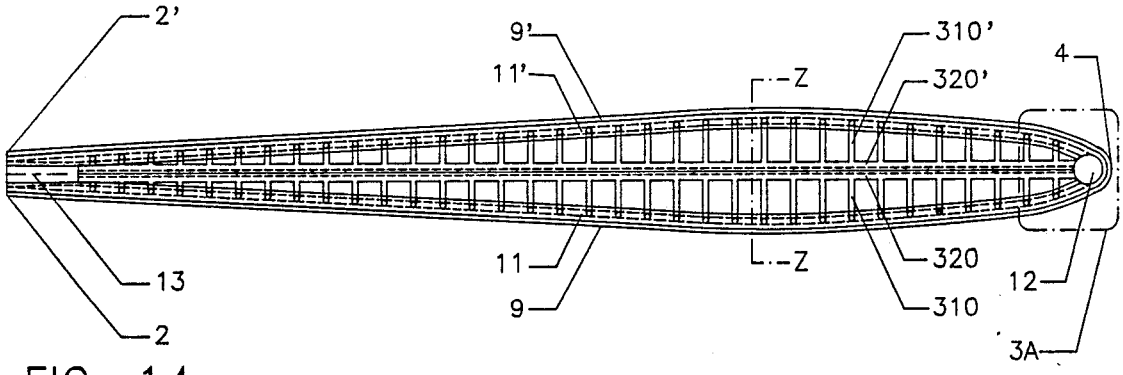
FIG. 14: Is a diagrammatical plan view of Type III batten assembly system consisting of draft members fixed upon one side of each of the two chordal members extending along the neutral axis.
Figure 24:
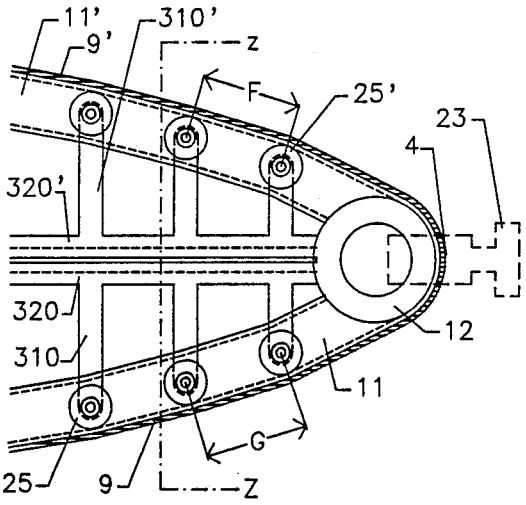
FIG. 24: Detail 3A of FIG. 14.
Figure 25:
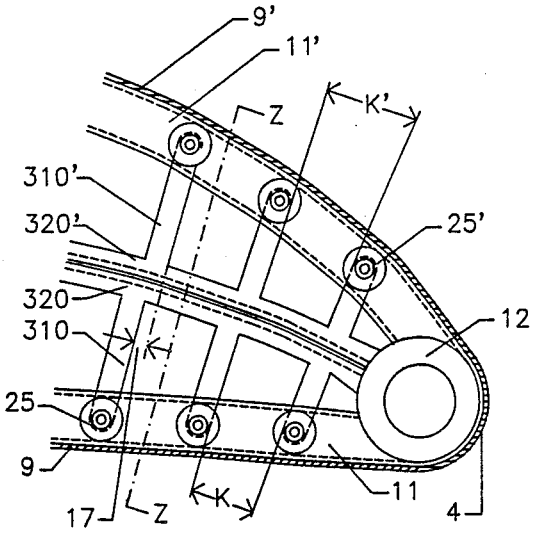
FIG. 25: Detail 3B of FIG. 15.
Figure 33:
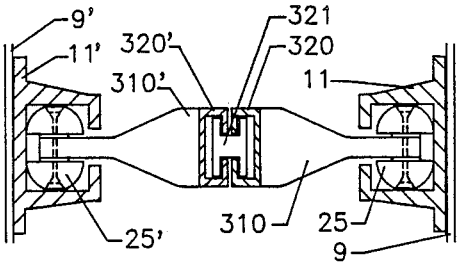
FIG. 33: Section Z—Z of FIGS. 14, 15, 24, 25.

FIG. 14 illustrates Type III batten assembly in its neutral state. Draft members 310 and 310' are non-flexible members rigidly affixed to two spline members 320 and 320' respectively, and each span one half of the corresponding chordal draft. Spline members 320 and 320' originate from luff assembly 12 and extend towards the leech, and are interconnected in a manner to provide a longitudinal sliding action against one another, in this case via a flexible connector 321 as shown in FIG. 24, FIG. 25, and FIG. 33, wherein said spline members 320, 320' and 321 are all capable of resisting compression longitudinally and yet flexing laterally, vertically and torsionally along and around their individual longitudinal axes, in conformance to the torsional changes transforming the neutral chordal plane into a warped surface.

Figure 15:
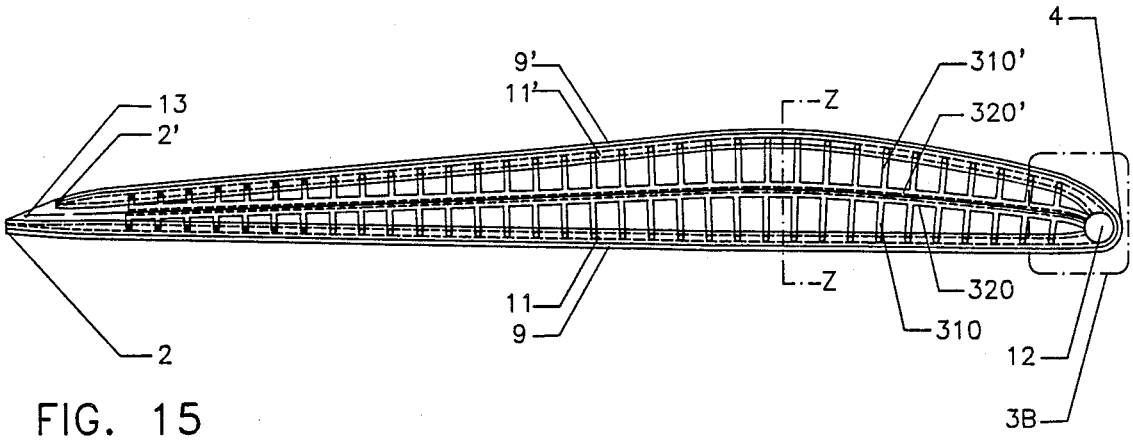
FIG. 15: Is a diagrammatical plan view of Type III batten assembly in FIG. 14 showing system action in working state at starboard tack.

FIG. 15 shows Type III batten assembly in its working state. The load transmission between the windward and leeward surfaces occurs through the same action sequence described in Working Stage Definition B. The longitudinal spline members 320 and 320' are shown to have flexed laterally while sliding against each other longitudinally along their common interface as shown in FIG. 33, along the camber line 13 of which purpose is to reduce longitudinal stresses in a spline structure. Further explanation of the action is given in FIG. 24 and FIG. 25.

Figure 16:
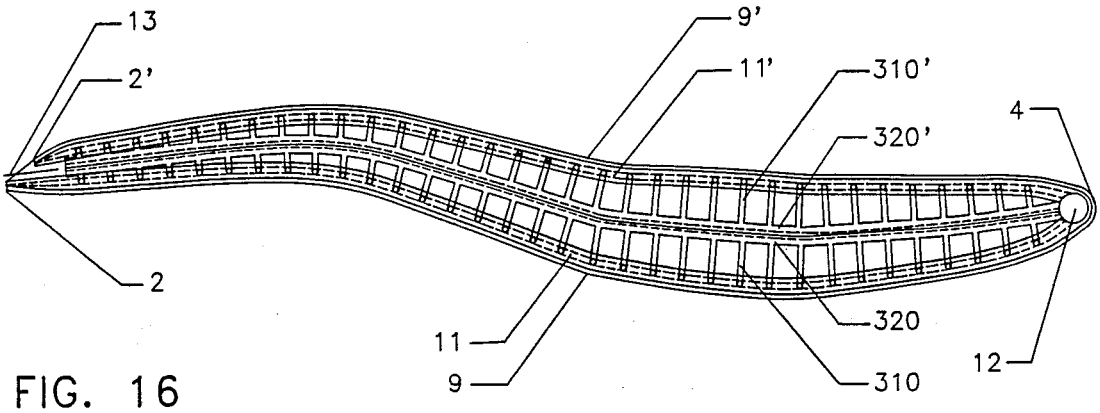
FIG. 16: Is a diagrammatical plan view of Type III batten assembly showing system in oscillation in luffing state.

FIG. 16 shows the luffing state of Type III batten assembly oscillating freely.

Figure 17:
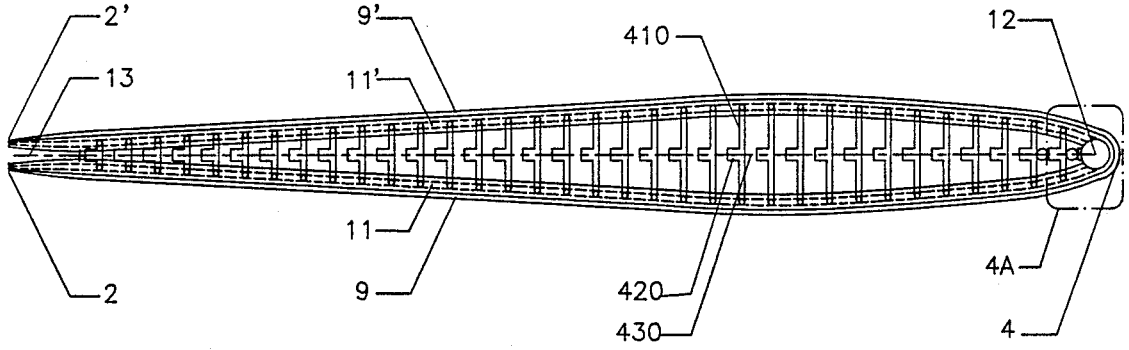
FIG. 17: Is a diagrammatical plan view of Type IV batten assembly system consisting of draft members hinged to each other along the neutral axis.

FIG. 17 shows Type IV batten assembly in its neutral state. Draft members 410 are rigid members that span the entire chordal draft between the batten channels 11 and 11'. Each draft member 410 is attached to the adjacent draft members by means of universal joints consisting of vertical hinges 430 and horizontal hinges 431, so that each draft member 410 can swing relative to the adjacent draft members 410 laterally, as well as on the transversal vertical planes crossing both fairing surfaces and the longitudinal vertical planes extending between luff and leech. 420 are intermediary extensions which are connected to draft members 410 by means of horizontal pins 432 which permit the draft members 410 to rotate around their longitudinal axes relative to each other.

Figure 18:
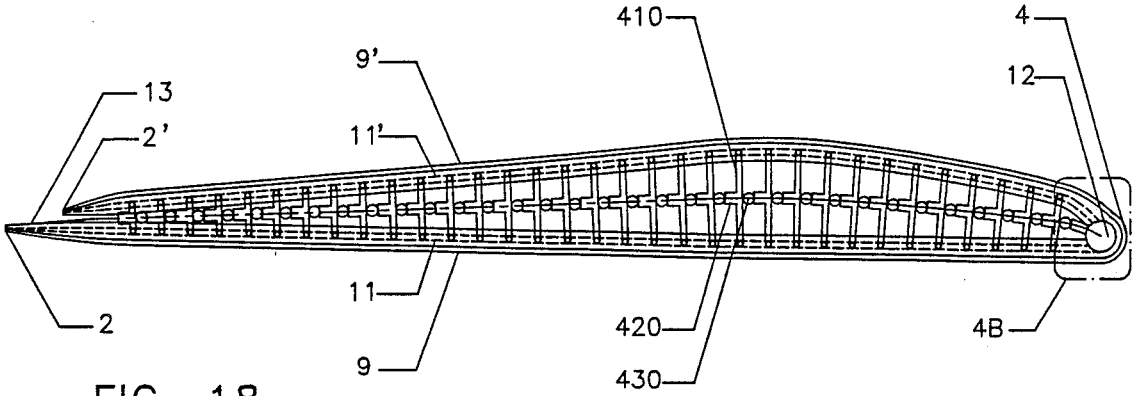
FIG. 18: Is a diagrammatical plan view of Type IV batten assembly in FIG. 17 showing system action in working state at starboard tack.

FIG. 18 shows Type IV batten assembly in its working state. The load transmission between the windward and leeward surfaces occurs through the same action sequence described in Working Stage Definition B. Further explanation of the action is given in FIG. 26 and FIG. 27.

Figure 19:
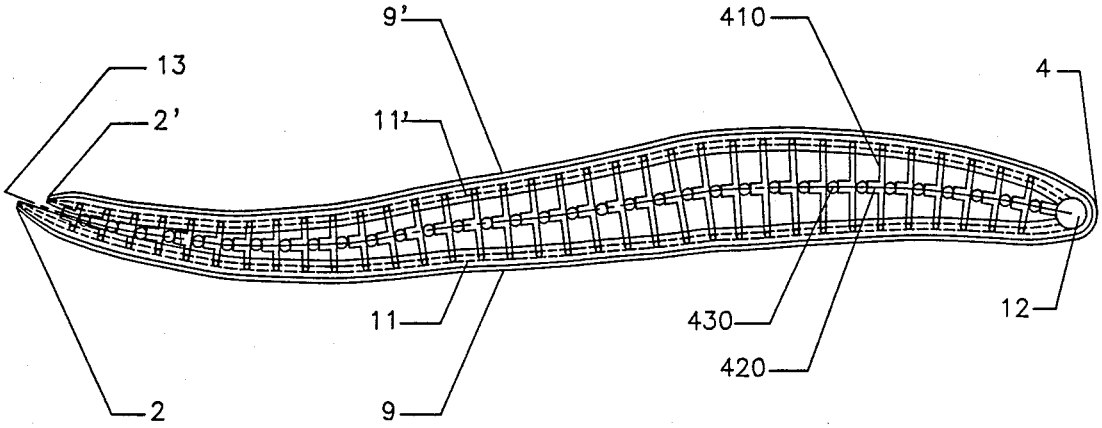
FIG. 19: Is a diagrammatical plan view of Type IV batten assembly showing system in oscillation in luffing state.

FIG. 19 shows the luffing state of Type IV batten assembly oscillating freely.

FIG. 20 illustrating the neutral status of Type I batten assembly detail 1A of FIG. 8, the distance D denotes the leech chord between any two tips 25'A and 25'B, which is equal to leech chord DA between the tips 25A and 25B at the opposite end of the same draft members. 113 are connectors which are on one side rotatably attached to draft members 110 by means of pins 114, and on the other side feature a semi-closed channel to accommodate the T-shaped tongue of the adjacent draft member, as seen in section W—W illustrated in FIG. 34.

Figure 31:
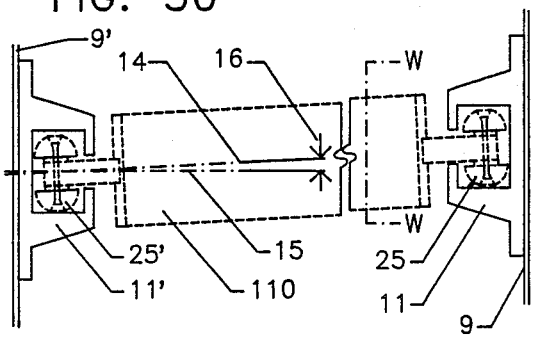
FIG. 31: Section X—X showing displacement on the vertical plane.

FIG. 21 is showing the detail 1A in an action stage where the draft members 110 have been laterally displaced to port side due to the higher surface pressure on the starboard surface 9, and hence the lateral distances E' and D' between tips 25'A and 25'B are greater than their status in FIG. 20, E and D respectively, whereas D' becomes greater than DA'. The increase shown in distances D' and E' is the traveling function of the draft member tips 25 in the batten channels 11 which is repeated on all draft members, as the chordal distances of each tip 25 and 25' vary. In such an action stage, each draft member 110 deviates from the horizontal plane in conformance to the torsional changes in the chordal plane, as shown in FIG. 31, where each draft member 110 attains a slightly different angle 16.

Figure 22:
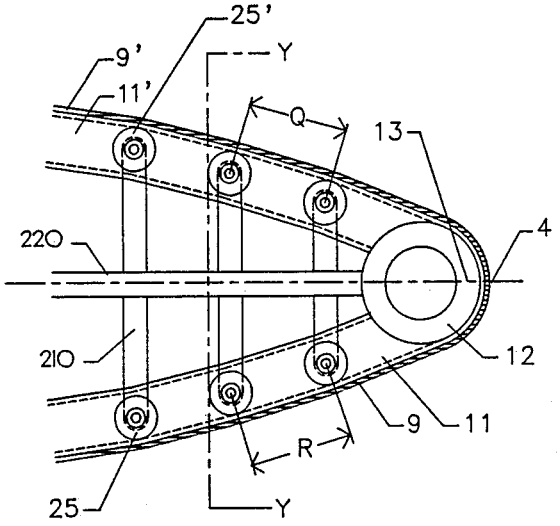
FIG. 22: Detail 2A of FIG. 11.

FIG. 22 is detail 2A of FIG. 11 showing the Type II batten assembly in its neutral state. Draft members 210 are attached rigidly and at right angles to a longitudinal spline member 220, which extends from luff assembly 12 towards the leech, whose longitudinal axis is identical to the neutral axis 13. Spline member 220 is a structure capable of flexing as described in FIG. 11. Draft members 210 span laterally between batten channels 11 and 11'. Draft member tips 25 and 25' are movably placed in batten channels 11 and 11', respectively, and are shown at section Z—Z seen in FIG. 32. Distances Q between tips 25' are equal to their symmetrical counterparts R between tips 25.

Figure 23:
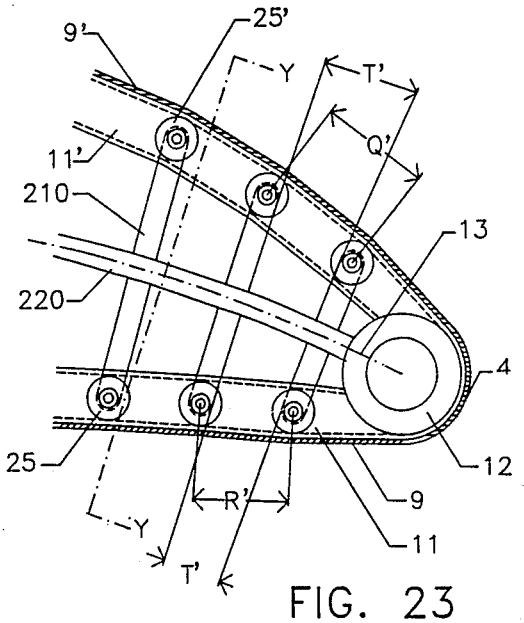
FIG. 23: Detail 2B of FIG. 12.

FIG. 23 shows the displacement pattern of the members described in FIG. 22 in its working state, where under a higher surface pressure acting upon starboard surface 9, and as the camber line 13 curvature varies, draft members 210 are displaced laterally, yet are kept at a perpendicular attitude to the spline member 220, which geometrically is the normal to the identical curvatures of both the camber line 13 and spline member 220. A rotational motion is performed as a result, simultaneously with a lateral displacement relative to the spatial status observed in the neutral state. Hence, the comparative status of the draft members 210 is such that $Q'>Q$ and $R'<R$, where the length of the arc T' between two adjacent members 210 becomes greater than that of arc T due to the rotation of draft members 210. The magnitude of rotation of the draft members 210 around their pivotal centers at their intersection with the camber line is limited by the fact that the travel distance of tips 25 is limited by the curvatures of the batten channels 11 and 11', which do not conform to arcs centered around the pivotal center of draft members 210.

FIG. 24 is detail 3A of Type III batten assembly in FIG. 14, shown in its neutral state. Distances F between all port tips 25' are equal to corresponding starboard distances G between 25. Port draft members 310' are aligned with starboard draft members 310.

FIG. 25 is detail 3B of FIG. 15, showing the displacement status of the members shown in 3A, under a higher surface pressure condition occurring on the starboard surface 9. Angle K' becomes greater than K. The magnitude of described rotation is limited by the fact that the rotational distance of tips 25 within batten channels 11 and 11' is limited by the curvatures of the said batten channels 11 and 11' which do not conform to arcs centered around the pivotal center of draft member 310. Spline members 320 and 320' flex at curvatures conforming to camber line 13 featuring the flexing capabilities described in FIG. 14. Windward starboard spline 320 slides along port spline 320' due to its longer chordal length. Hence, all windward draft members are displaced toward leech relative to their counterparts in the port side. The described sliding feature is an improvement over the Type II batten assembly system contemplating a means to reduce internal stresses occurring in the flexible spline structure upon which the draft members are secured.

Figure 26:
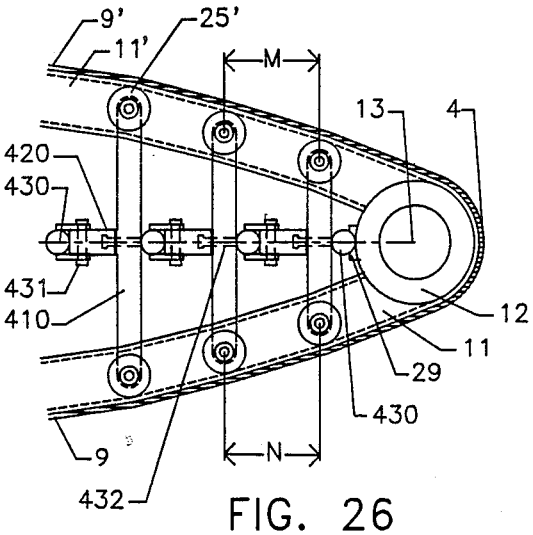
FIG. 26: Detail 4A of FIG. 17.

FIG. 26 is detail 4A of FIG. 17 showing the Type IV batten assembly system in its neutral state. Distance M is equal to N, while camber line 13 forms a straight line.

Figure 27:
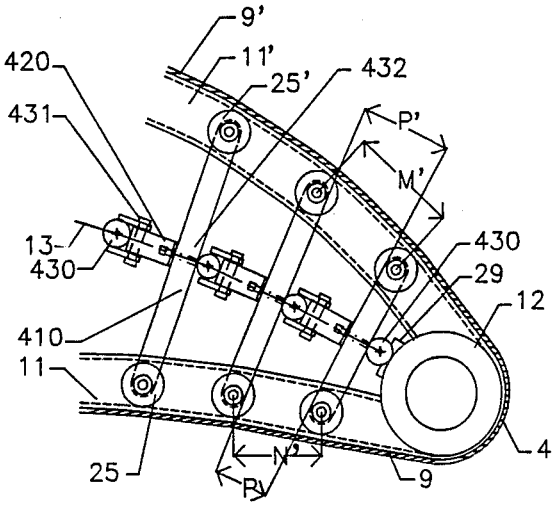
FIG. 27: Detail 4B of FIG. 18.

FIG. 27 is detail 4B of FIG. 18 showing the system in its working state. Draft members 410 are pushed towards leeward as a result of the higher surface pressure shown to be occurring on the starboard surface 9. Leeward distance M' becomes greater than windward distance N', creating an angle P between draft members 410 which are pivoted around hinges 430, 431 and 432, which are aligned with the neutral axis 13. The magnitude of the described rotation on the chordal surface is limited by the fact that the travel distance of tips 25 is limited by the curvatures of the batten channels 11 and 11', which do not conform to arcs centered around the pivotal center of hinge 430.

Figure 28:
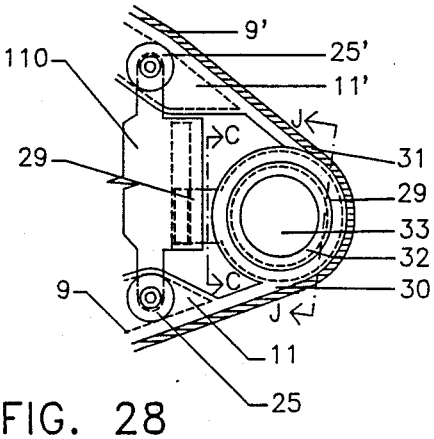
FIG. 28: Plan view detail of luff assembly.

FIG. 28 is a plan of luff member assembly 12, which is an embodiment of a detail common to all batten assembly systems disclosed. The detail serves the purpose of contributing an additional capability of being rotationally displaced to the flexing function of the batten channels 11. As seen in cross section J—J shown in FIG. 29, the hollow cylinder member 32 in the center of the assembly is the element around which an array of concentric rings are rotatably fitted to permit limited but independent concentric rotation of batten channel members 11 and 11' and luff connector member 34 which, varying according to different embodiments, is shown to have been connected to spline members 220, 320-320', and hinge 430, and as shown in this illustration, to draft member 110, at match line C—C. Batten channel 11 is connected to ring 30, batten channel 11' is connected to ring 31, and connector 34 is fixed onto ring 29 (See FIG. 29). The opening 33 formed by the hollow cylinder member 32 in its center is used for accommodating the rigging component designated to support the airfoil. The same opening 33 can also accommodate intermediary members attaching the airfoil to the designated component of the rigging.

Figure 29:
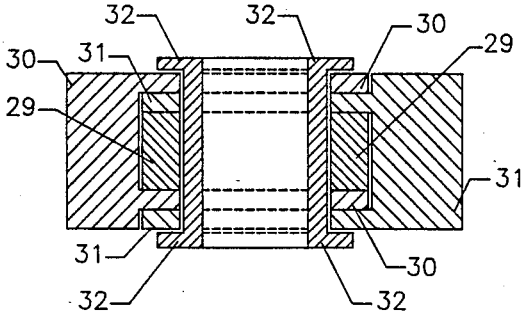
FIG. 29: Section J—J of FIG. 28.

FIG. 29 is cross section J—J of FIG. 24. Hollow cylinder 32 is the center member around which rings 30, 31 and 29 are rotatably mounted. Batten channel 11 is fixed onto ring 30, batten channel 11' is fixed onto ring 31, connector member 34 as seen in FIG. 28 is fixed onto ring 29.

Figure 30:
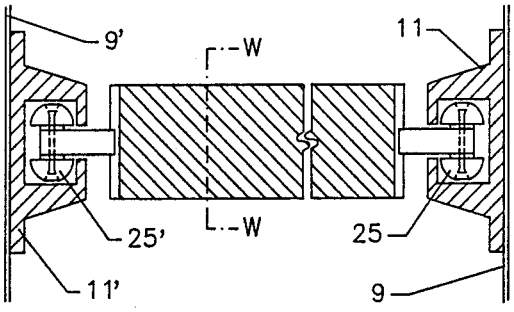
FIG. 30: Section X—X of FIGS. 8, 9, 20, 21.

FIG. 30 is the longitudinal section X—X of draft member 110 of batten assembly Type I in the neutral state of action. Fairing surfaces 9 and 9', batten channels 11 and 11', draft member tips 25 and 25', are common elements in all batten assembly types.

FIG. 31 illustrates a limited vertical rotation of tips 25 and 25' and subsequently of the draft members 110, (also of 210, 310 and 410) in batten channels 11 and 11' at an angle 16, which is formed between the chordal plane 14 and the chordal surface 15, a feature which is a function of size relationship between the channel element of the batten channels 11 and 11' and the draft member tips 25. The capability described in this illustration accommodates the spatial variation occurring on the chordal plane of a batten assembly in its neutral state, wherein the said variation is the transformation of the said chordal plane into a warped surface which is defined by the starboard and port batten channels 11 and 11' consecutively, and as described in FIG. 2, according to which the angle 16 varies between draft members as a common status for each type of batten assembly.

Figure 32:
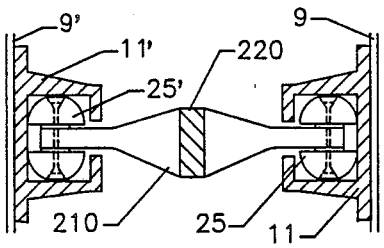
FIG. 32: Section Y—Y of FIGS. 11, 12, 22, 23.

FIG. 32 is the cross section Y—Y of batten assembly system Type II where 9 and 9′ are fairing surfaces, and 11 and 11′ are batten channels in which tips 25 and 25′ are movably placed and 210 are draft members affixed rigidly at right angles to the spline member 220. Tips 25 and 25′ and subsequently draft members 210 are capable of rotating on the chordal surface and on the transversal vertical plane and centered around the tips 25, as shown in FIG. 31.

FIG. 33 is a section Z—Z across batten assembly system Type III where 9 and 9′ are fairing surfaces, 11 and 11′ are batten channels in which tips 25 and 25′ are movably placed and 310 and 310′ are draft members affixed rigidly at right angles to spline members 320 and 320′, respectively. Tips 25 and 25′ and subsequently draft members 310 and 310′ are capable of rotating on the chordal and the vertical planes centered around the tips 25. Spline members 320 and 320′ are related to each other by a detail that allows the spline members to longitudinally slide against each other along the neutral axis of the batten assembly while keeping the opposite draft members on the same plane. The illustrated embodiment relates semi-closed channel shaped spline members 320 and 320′ by means of an H-shaped connector 321 which has the same flexure and compression characteristics of the spline members 320 and 320′ as explained in the FIG. 14.

FIG. 34 is section W—W across draft members 110 of batten assembly Type I as seen in FIG. 20, FIG. 22, and FIG. 23. Draft members 110 are connected to each other by means of a detail allowing each member to slide against each other along their lengths as suggested in the embodiment. 111 is a semi-closed channel in connector member 113 and 112 is a T-sectioned tongue extending along the draft members 110. The spatial relationship between channel 111 and tongue 112 is such that it also provides a vertical play between the draft members to accommodate the geometrical status shift of the chordal plane when it becomes a warped surface in the working state of action.

Figure 36:
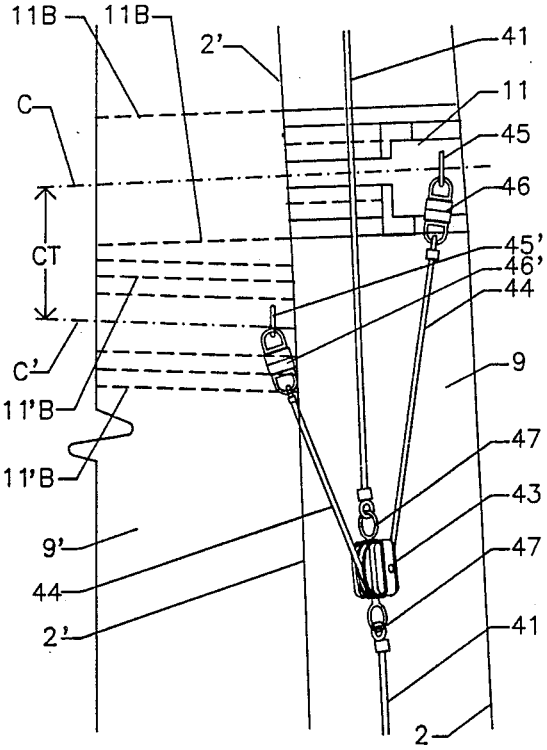
FIG. 36: Port side view of the leech end of a batten assembly and the intermediary leech tension self-adjusting means shown in the working state of action.
Figure 35:
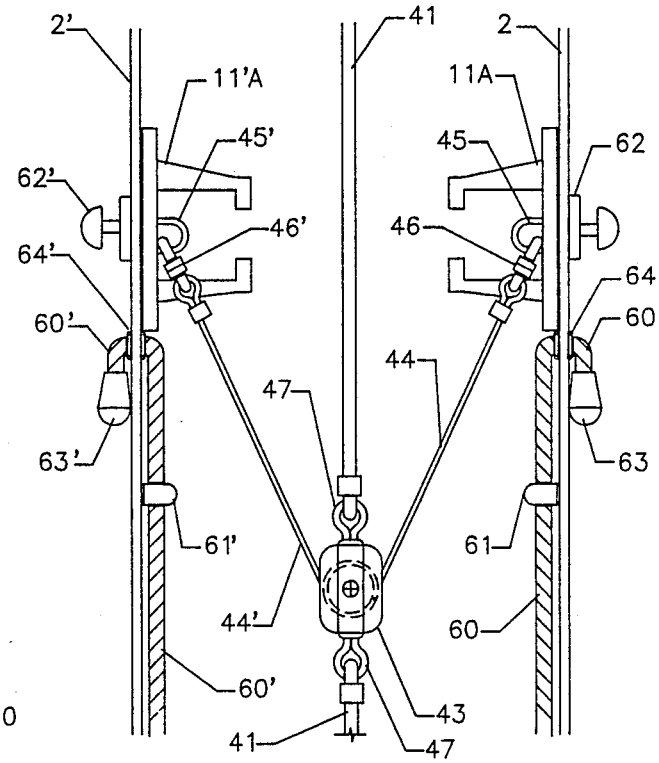
FIG. 35: Leech view of the leech end of a batten assembly and the intermediary leech tension self-adjusting means shown in the neutral state of action.

FIG. 35 is a leech elevation of the leech ends of a randomly chosen batten assembly, while the airfoil is in its neutral state. 11A and 11′A indicate the channel profiles of the starboard and port side batten channels 11 and 11′, respectively, as seen beyond according to the projection. 2 and 2′ are the leeches of windward and leeward fairing surfaces, respectively, which are not marked for the purpose of clarity. Neutral leech tension cord 41 runs between the intermediary leech tension blocks 43, upon which they are connected with swiveled eyes 47. Neutral leech tension cord 41 constitutes the leech end of the camber line at any chordal section, and adjustably tensioned at its boom 52 end so that the airfoil maintains a constant neutral leech chord length NC in the working state of the airfoil. Intermediary leech tension cord 44 runs from eye 45 which is rigidly attached to the aft extension of starboard batten channel 11 and after passing through the intermediary leech tension block 43, to the leeward eye 45′ which is rigidly attached to the aft extension of port side batten channel 11′, as also seen in the side views in FIG. 36, repeating the same at all batten assemblies. The length of cord 44 is determined in accordance with the designed relative displacement status between the leech end of batten channels 11 and 11′ in the working state and as shown in FIG. 36. 46 and 46′ are swiveling linkages with tension adjusting capability, and are used to shackle cord 44 to eyes 45 and 45′. Reef tie line 60 is seen beyond, running vertically along the inside faces of both fairing surfaces 9 and 9′, between consecutive batten channels. Reef tie lines 60 may start from a batten channel or its vicinity and run vertically either upward or downward according to a particular design. In the embodiment illustrated, reef tie lines 60 run upward and after passing through eyes 61, which are attached to the fairing surfaces, exit through reef eyes 64 and are terminated with knobs 63 to prevent escape back through the reef eyes 64. 62 are the cleats used for cleating the reef lines and are attached upon the fairing surfaces at the level of the batten channels.

FIG. 36 is a port side elevation of the leech end of a randomly chosen batten assembly, while the airfoil is in its working state, and windward side being the starboard side. 11B denotes the top and bottom edges of the starboard batten channel 11 which is seen to be extending towards the luff behind the leeward fairing surface 9′ in the projection. The eye 45′ and the linkage means 46′ are placed on the inside face of the port fairing surface 9′ and hence are seen behind the said surface 9′ in the projection. According to the working stage of action, the windward batten channel 11 is seen to have extended farther aftward relative to the leeward batten channel 11′ and attained a longer leech chord C relative to C′, (also see FIG. 6) and its leech end has rotated upward at the radius of its leech length relative to head 3, while the leeward batten channel 11′ has increased its original camber and attained a shorter leech chord C′ by the same windward pressure force. The length of the intermediary tension chord 44 is determined so that as the leeward termination means 46 is displaced aftward and upward, the leeward termination and linkage means 46′ pulls the leeward eye 45′ downward, helping to create the angle CT between the horizontal projections of leech chords C and C′. Since the loads in the working state do not generate any upward force components upon the leeward leech 2′, the downward pull transmitted by the cord 44 via block 43 of which distance from the head 3 remains constant, and upon the leeward batten channel 11′ as described in the preceding, provides the tension to keep the leeward leech 2′ taut enough to prevent fluttering of the said leech.

Figure 37:
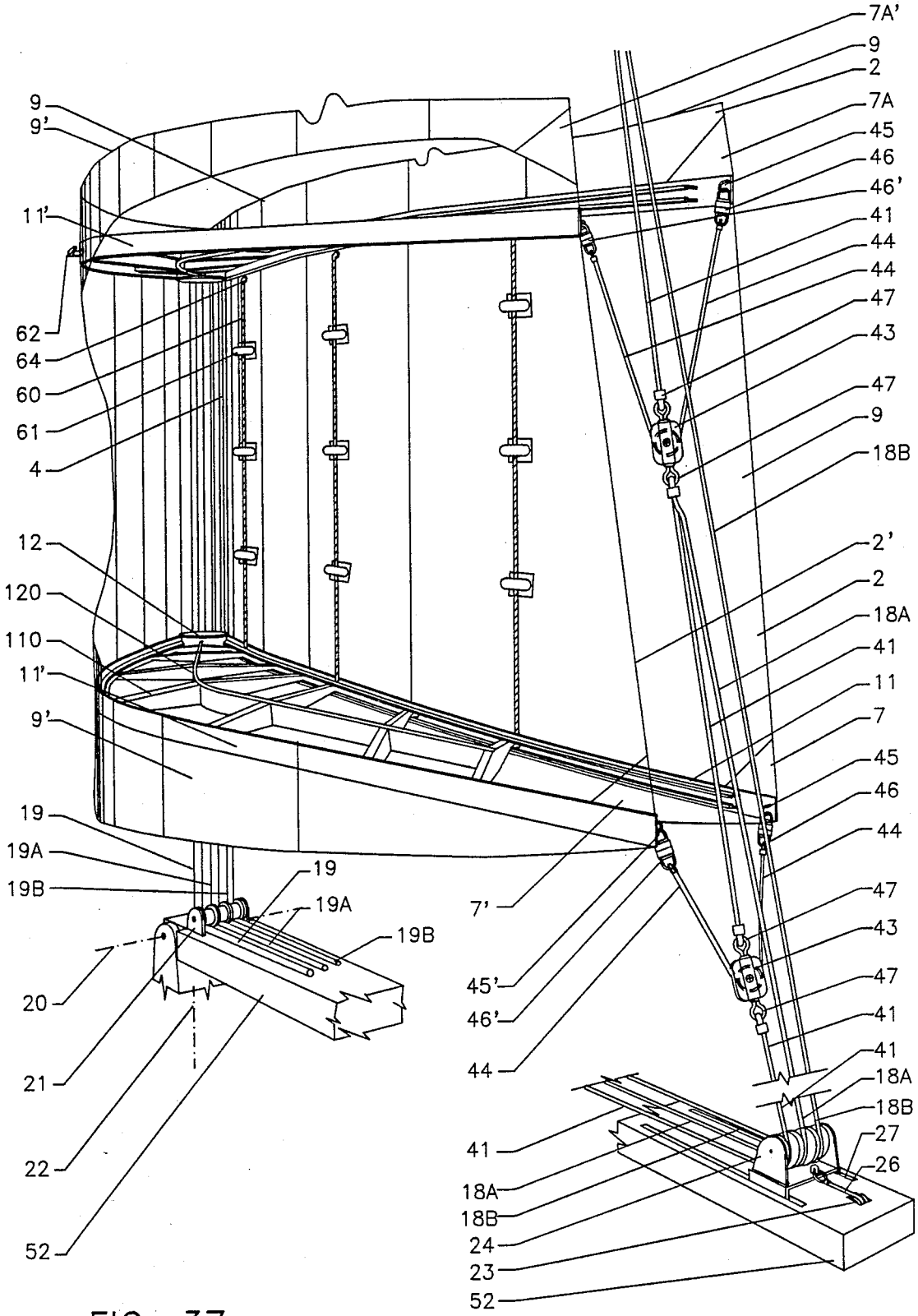
FIG. 37: Is a perspective illustration depicting the disclosure from a vantage point on the port side and aftward quarter, while the airfoil is in its working state.

FIG. 37 is a three dimensional depiction of the lower portion of the embodiment. The vantage point is at the port aft quarter of the airfoil. Port fairing surface 9′ is also the leeward surface and is shown only partially to expose the volume in between the two fairing surfaces 9 and 9′. In addition to the members and elements introduced in the preceding, parallel channels 27 are illustrated at the aft end of the boom 52, providing travelling means for the traveller block 24. Cord 26 which provides aftward motion for the traveller block 24, is routed around fixed block 23, to lead forward.

Lines 19, 19A and 19B leading from tacks 8, 8A and 8B which are seen in FIG. 1 and FIG. 2 are routed around fixed block 21 for convenience of operation. Boom 52 is attached to the craft so that it is vertically rotatable around the horizontal axis 20, and also horizontally rotatable around the vertical axis 22, which also is shown in FIG. 1 and FIG. 2.

What I claim is:

1. A flexible airfoil assembly functioning as a wing sail, said airfoil comprising:

(a) membrane sheets covering its sides to constitute flexible fairing surfaces so cut to feature sail twist;

(b) means for receiving attachment members connecting the said airfoil to a hoisting means, mounted at the head of the said airfoil;

(c) means for reefing the said airfoil;

(d) a boom running along the foot of the said airfoil, to which the said airfoil is adjustably attached.

(e) a plurality of batten assemblies constituting a variable spatial relationship between the said fairing surfaces, between which they are placed at vertical intervals along the span, extending from luff to leech wherein each said batten assembly is capable of attaining an asymmetrical chordal shape featuring a variable and reversible camber line achieved by the function of laterally movable and flexible members transmitting loads between the said fairing surfaces, creating different fairing curvatures on each side, wherein the said action of assuming, reversing and varying the chordal shape is achieved as a response to the higher surface pressure on the windward fairing surface at any tack and any attitude therein during operation, wherein said batten assemblies are capable of oscillating when said airfoil is luffed;

(f) a set of draft members at each batten assembly, placed transversally with respect to the camber line on the chordal plane forming a draft member assembly, and of which lengths vary congruously conforming to the pre-engineered chordal drafts corresponding to the location of each said member along the camber line, whereas said draft members are movably related to each other in such a manner that said draft members can be displaced against each other transversally, wherein the distance of each said member from the point of its intersection with the camber line to the chordal length varies, but the curvilinear distance from the same point to luff remains constant along the camber line;

(g) flexible batten channels placed in between each draft member assembly and the inside face of the fairing surfaces on both sides, whereas each batten channel features a longitudinal receptacle along its length, of which function is to receive the endpoints of said draft members, while the said batten channels are capable of flexing in conformance to the curvature determined by the variable loci of the endpoints of the said draft members, whereby upon which said batten channels, said fairing surfaces are removably attached;

(h) means to terminate the said draft members at their endpoints which allows the said draft members to be movably received by, and to travel longitudinally along the length of the said receptacle of the batten channels, and also to allow pivotal movement around the said endpoints;

(i) means to terminate the draft assembly at the luff, where the said batten channels and the draft member assembly are attached to their respective members which in turn are concentrically and rotatably assembled around a center element featuring an opening to serve as a receptacle means to receive means to relate the airfoil to a support system, wherein the total interaction of the said constituent members of the said batten assembly allows any one of the fairing surfaces upon which a higher surface pressure is built up, to push the said batten channels of its respective side to leeward, forcing them to conform to its acquired curvature in response to the said surface pressure, and hence cause the said batten channels to push the said draft members laterally with respect to the camber line and towards the leeward side, and in turn forcing the leeward batten member and the leeward fairing surface to conform to the curvature created by the locus of the leeward tips of the draft members.

2. An airfoil assembly according to claim 1, which comprises a leech tensioning means for exerting downward and aftward tension on the leeches of both said fairing surfaces, wherein the said leech tensioning means further comprising intermediary leech tension self-adjusting means that automatically transmits the aftward and upward forces created upon the windward batten channels to the leeward leech to pull the said leech downward, when the windward fairing surface is loaded in the working state.

3. An airfoil assembly according to claim 2, wherein the said leeward leech tension self-adjusting means further comprises:

(a) an intermediary tension cord, at least one for each batten assembly, starting from one of the clews to which it is linked so to provide movement in the manner of being shackled, running through an intermediary tension block situated below the lowest leech end level of both batten channels which also feature a shackle receptacle at both ends of its cheek strap direction which runs parallel to the leech end of the airfoil, and said cord ending at the opposite clew to which it is also movably attached; whereby the length of the said cord is determined in accordance with the designed distances, in the working state of the said airfoil, running from one clew to the intermediary tension block and from the said block to the opposite clew;

(b) a plurality of main leech tension cords starting from the head and running between each said intermediary leech tension blocks, and following a path intersecting the camber line of each batten assembly while being aligned with the neutral cheek strap axis of each said block to which each said cord is movably attached, whereas the last said main leech tension cord terminates at the intermediary leech tension block closest to the boom.

4. An airfoil assembly according to claim 3, wherein the said airfoil further comprises leech reefing means to reef in the reefing clews, said means including cords running down to their respective sheaves upon the boom, from each of the intermediary leech tension blocks corresponding to the designated reefing clews.

5. An airfoil assembly according to claim 4, wherein the said leech reefing means further comprises:

(a) a travelling means on the boom to accommodate a traveller which is movable longitudinally along the aft portion of the boom; wherein the said traveller bearing sheaves mounted such that each of said sheaves can accommodate a leech reef line leading from each of the intermediary leech tension blocks of all the batten assemblies designated to be fitted with reefing fittings, wherein each said leech reef line leading forward past its said respective sheave;

(b) a control line attached to said traveller, leading aft, going around a sheave mounted to the aft end of the said boom, after which the said control line then leading forward, the function of which being to control the aftward tension on the said traveller.

6. An airfoil assembly according to claim 5, further comprising reef lines leading from reef tacks downward to their respective cleats past their respective blocks, all of which are mounted upon the said boom.

7. An airfoil assembly according to claim 6, wherein the said boom further comprises:

(a) means to accommodate sheeting functions, (b) means to enable the said boom to swing on the transversally and vertically around its forward end where the said boom is attached to the craft upon which the said airfoil operates.

8. An airfoil assembly according to claim 7, wherein the reefing means further comprises:

(a) a plurality of reefing tie lines placed on the inside face of each fairing surface, at horizontal intervals between luff and leech, wherein each said tie line starting at the batten channel of the respective surface upon which it is mounted, travelling vertically, and then exiting to the outer face of the said respective fairing surface through a reef hole placed at a level at a vertical distance to the batten from which the said tie lines depart;

(b) a plurality of loops attached to the inside face of the fairing surfaces in such a manner that the said tie lines run through the said loops along their route from one batten channel to the one above;

(c) a plurality of cleats each placed horizontally by the said reef holes, on the outer face of the said respective fairing surface, and each serving the said reef tie lines.

9. An airfoil assembly according to claim 8 further comprising a membrane transom secured to the leeches of both said fairing surfaces, extending continuously from head to clews of both fairing surfaces, leaving the said leech tensioning means and the said leeward leech tension self-adjusting means inside the enclosure defined by the fairing surfaces and the said membrane transom, wherein the width of the said membrane transom is determined so that when the gap between the leeches reaches to its maximum in the working state of action, the said intermediary membrane transom attains a congruous flat shape, in order to maintain a clean airflow on the leech zone of the leeward fairing surface.

10. An airfoil assembly according to claim 9, wherein the said membrane transom is made of elastic membrane material.

11. An airfoil assembly according to any one of claims 8, 9, 10, wherein each of the said batten assemblies further comprises a draft member assembly featuring a set of draft members of varying pre-determined individual lengths corresponding to the designed chordal draft of the chordal profile at their specific locations, assembled along the chordal reach and intended to be movably interconnected to each other such as to allow each draft member to be displaced along the adjacent draft members at transversal ordinates relative to said camber line, and also to allow the said members to rotate around the center of their interconnection means and on the transversal vertical plane, wherein the draft member closest to the luff is related to its respective luff member in the same manner, hence rotatably connecting the said draft member assembly to the said luff assembly.

12. An airfoil assembly according to any one of claims 8, 9, 10, wherein each of the said flexible batten assemblies further comprises a draft member assembly featuring a spline member stemming from a luff connector member horizontally rotatable around the vertical axis of the luff assembly and extending therefrom to the leech while its own longitudinal axis being the same with the camber line of the said batten assembly; wherein the said spline member is capable of flexing transversally and vertically and torsionally along and around its longitudinal axis and yet retaining a constant length; wherein along the length of the said spline member a plurality of draft member pairs mounted rigidly at longitudinal intervals on the chordal plane, and each pair extending outwardly towards opposite batten channels, hence spanning the chordal draft corresponding to their locations, and of which said draft members individual lengths varying correspondingly to the intended curvature of the chordal profile.

13. An airfoil assembly according to any one of claims 8, 9, 10, wherein each of the said flexible batten assemblies further comprises a draft member assembly consisting of at least tow flexible spline members with constant lengths stemming from their common pivotal attachment means to the luff assembly and extending therefrom to the leech, and movably interconnected to each other to allow only a longitudinal sliding motion of each said spline member against each other along their common interface and hence along the neutral axis; whereby a plurality of draft members rigidly mounted on each of the said spline members at longitudinal intervals and each extending outwardly towards and movably connecting to the batten channel on the side corresponding to the side of the spline member upon which the said draft member is attached, whereas the individual lengths of each said draft members varying correspondingly to the half depth of the designed overall depth of the chordal profile at the relative location of the said draft members along the chordal reach.

14. An airfoil assembly according to any one of claims 8, 9, 10, wherein each of the said flexible batten assemblies further comprises a draft member assembly consisting of a set of individual members each spanning the full depth of the chordal draft corresponding to their relative location along the chordal reach; whereas the said draft members attached to each other at their longitudinal centers by means of members which swivel around the direction of the camber line and also provide the movement capabilities of a universal joint.

* * * * *